US008565455B2

(12) United States Patent
Worrell et al.

(10) Patent No.: US 8,565,455 B2
(45) Date of Patent: Oct. 22, 2013

(54) MULTIPLE DISPLAY SYSTEMS WITH ENHANCED ACOUSTICS EXPERIENCE

(75) Inventors: Devon Worrell, Folsom, CA (US); Vishnu Balraj, Folsom, CA (US); Srikanth Kambhatla, Portland, OR (US); Kar Leong Wong, Perak (MY)

(73) Assignee: Intel Corporation, Santa Clara, CA (US)

( * ) Notice: Subject to any disclaimer, the term of this patent is extended or adjusted under 35 U.S.C. 154(b) by 912 days.

(21) Appl. No.: 12/347,899

(22) Filed: Dec. 31, 2008

(65) Prior Publication Data

US 2010/0166193 A1 Jul. 1, 2010

(51) Int. Cl.
*H04R 5/00* (2006.01)

(52) U.S. Cl.
USPC ..... 381/306; 381/17; 381/18; 381/1; 381/300; 381/303; 381/307; 381/309; 381/310

(58) Field of Classification Search
USPC ..... 381/17, 18, 1, 300, 303, 306, 307, 309, 381/310, 11
See application file for complete search history.

(56) References Cited

U.S. PATENT DOCUMENTS

| | | | | |
|---|---|---|---|---|
| 5,594,800 | A * | 1/1997 | Gerzon | 381/20 |
| 7,602,924 | B2 * | 10/2009 | Kleen | 381/61 |
| 7,630,501 | B2 * | 12/2009 | Blank et al. | 381/58 |
| 2005/0262252 | A1 * | 11/2005 | Gries | 709/231 |

* cited by examiner

*Primary Examiner* — Matthew Reames
*Assistant Examiner* — Benjamin Tzu-Hung Liu
(74) *Attorney, Agent, or Firm* — Lynch Law Patent Group, P.C.

(57) ABSTRACT

A method and a system are described providing multiple display systems with an enhanced acoustics experience. A source audio signal having a plurality of source audio channels is generated from an audio signal source. The system includes a plurality of speakers connected to a plurality of display systems. A speaker configuration gatherer determines the spatial configuration of the speakers. An audio signal processor is provided to generate synthesized audio signal based on the contents of the source audio signal and spatial configuration of the speakers. The synthesized audio signal is mapped and delivered to the speakers to produce an enhanced sound field.

13 Claims, 5 Drawing Sheets

MULTIPLE DISPLAY SYSTEMS WITH ENHANCED ACOUSTICS EXPERIENCE

FIELD

Embodiments of the invention relate to an acoustics enhancement system and method. More particularly, embodiments of the invention relate to a system and method for enhancing an acoustics experience in relation to acoustics provided by multiple display systems.

BACKGROUND

Audio-visual (AV) displays generally support at least two speakers where audio signals can be independently delivered to each of the speakers to produce a multi-channel sound field. Some displays have speakers built as part of the display and thus cannot be physically relocated by a user. A user may place two or more displays, for example in a side by side or a stacked configuration, to improve work productivity by having an extended desktop area as well as to gain wider area of vision for multimedia entertainment.

A listener may experience an inferior acoustics quality when multiple displays are placed side by side and the respective speakers generate sound based on audio signals delivered to the speakers. For the purpose of illustration, FIG. 1 is block diagram with audio signals channeled to two displays according to an example of the prior art. First display 100 is placed on the left side of second display 110. First display 100 includes left speaker $L_1$ and right speaker $R_1$ while second display 110 includes left speaker $L_2$ and right speaker $R_2$. When audio signals, for example, in a stereo audio stream consisting of left channel $I_L$ and right channel $I_R$ are delivered to displays 100, 110, left speakers $L_1$, $L_2$ will produce sound $O_L$ from left channel $I_L$ while right speakers $R_1$, $R_2$ will produce sound $O_R$ from right channel $I_R$. The close proximity between right speaker $R_1$ of first display 100 and left speaker $L_2$ of second display 110 distorts the stereo sound effect and delivers an inferior and possibly annoying acoustics to a listener.

A listener may avoid the inferior acoustics described above by disabling either both speakers $L_1$, $R_1$ of first display 100 or both speakers $L_2$, $R_2$ of second display 110. Alternatively, a listener may disable both right speaker $R_1$ of first display 100 and left speaker $L_2$ of second display 110. Such manual intervention underutilizes the aggregate potential of all the speakers to deliver a multi-channel sound field. A listener may also avoid the inferior acoustics by physically placing first display 100 above second display 110 or vice versa. Stacked displays may not be desirable to a listener particularly when a listener prefers to place the displays on the same plane of sight or the displays are setup on a common support such as a workstation.

BRIEF DESCRIPTION OF THE DRAWINGS

Embodiments of the invention are illustrated by way of example and not limited in the figures of the accompanying drawings, in which like references indicate similar elements.

DETAILED DESCRIPTION

Embodiments of the invention relate to a method and a system of providing multiple display systems with an enhanced acoustics experience. A source audio signal having a plurality of source audio channels is generated from an audio signal source. The system includes a plurality of speakers connected to a plurality of display systems. A speaker configuration gatherer determines the spatial configuration of the speakers. An audio signal processor is provided to generate synthesized audio signal based on the contents of the source audio signal and spatial configuration of the speakers. The synthesized audio signal is delivered to the speakers to produce an enhanced sound field.

Figure 1:
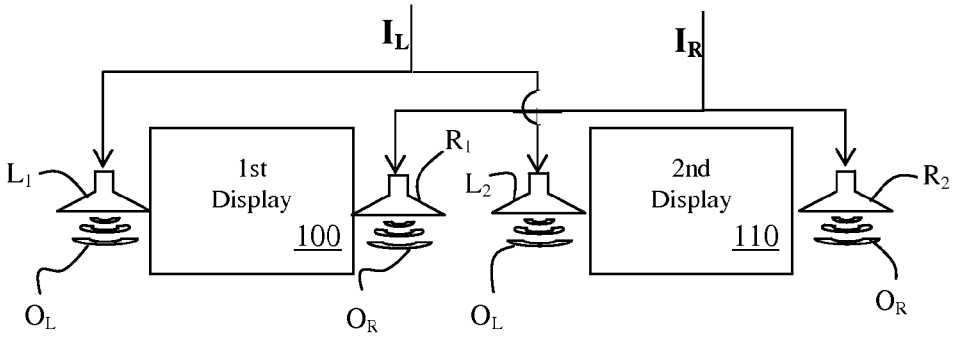
FIG. 1 (Prior Art)
FIG. 1 is block diagram with audio signals channeled to two displays according to an example of the prior art.
Figure 2:
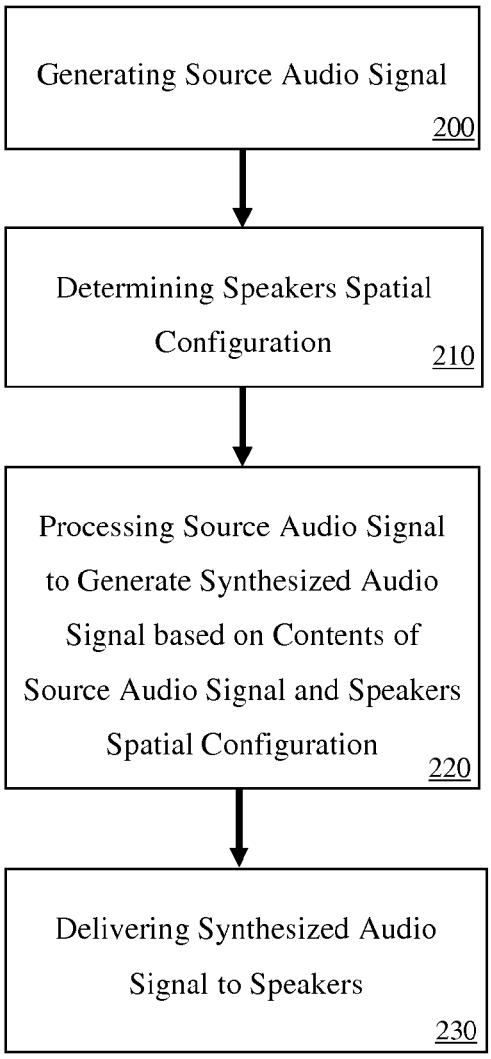
FIG. 2 is a flowchart of a method to generate synthesized audio signal with an enhanced acoustics experience according to an embodiment.

FIG. 2 is a flowchart of a method to generate synthesized audio signal with an enhanced acoustics experience according to an embodiment. In operation 200, source audio signal is generated. Source audio signal can be generated from various sources. For example, source audio signal may be generated via playback of a multimedia storage such as a DVD disc, Blu-ray disc (BD), game devices and set-top boxes. Source audio signal may also be generated from playback of software application such as games and movies. Source audio signal may be obtained as audio input from hardware such as a CD or DVD player built in a computer, and a portable media player. Source audio signal may be generated by way of downloading multimedia contents from the Internet or data servers. Source audio signal can also be generated by way of receiving source audio signal transmitted over a variety of medium such as over-the-air radio broadcasting, satellite broadcasting, and fiber optics cable transmission. Source audio signal is in digital form. Source audio signal may be converted to digital form from analog audio signal.

In operation 210 (in FIG. 2), the spatial configuration for a plurality of speakers connected to a plurality of display systems is determined. Each display system includes a left speaker and a right speaker. For various embodiments of the invention, a speaker is any device that is capable of generating audible sound perceived by a listener in open air. Embodiments of the invention include speakers that have separate transducers for different audio channels. The speakers are fixably connected to the respective display systems. The term "fixably connected" referred to the speakers of a display system means that the speakers cannot be physically relocated by a listener. For example, when a speaker is connected to the right side of a display system and is therefore configured to be the right speaker of the display system, the speaker will ordinarily generate sounds from the right channel of an audio stream. A listener cannot freely relocate the right speaker to the left side of the display system. Display systems as described in this specification refer to any audio-visual display device. Examples of a display system according to embodiments of the invention include, but are not limited to, plasma television, LCD television, and LCD computer monitor having built-in speakers.

The spatial configuration of the speakers includes the physical arrangement of the speakers relative to the respective display systems as well as the physical arrangement of a speaker relative to the other speakers. Determining the spatial configuration of the speakers includes determining the position of a speaker of a particular display system relative to the other speaker(s) of the same display system as well as the position of that speaker relative to the speakers of other display systems. Determining the spatial configuration of the speakers also includes determining which display system the speakers are connected to. The spatial configuration of the speakers may be two dimensional (2D) or three-dimensional (3D). For an embodiment, the spatial configuration of the speakers is determined from a listener's input. A listener provides information relating to the number of display systems in a setup, the number of speakers for each display system and the relative physical placement of the display systems and speakers in a setup. A listener may provide information relating to the spatial configuration of the speakers through a graphical user interface (GUI). A listener may also provide information relating to the number of display systems in a setup, the relative physical placement of the display systems and the model type of the display systems. The spatial configuration information of the speakers provided by a listener is linked to a database containing information relating to the spatial configuration of speakers for the particular model type of the display system. Hence, the spatial configuration of the speakers in a setup can be heuristically determined.

For another embodiment, the spatial configuration of the speakers is determined by a voice receiver. A voice receiver is any device capable of measuring the arrival time of the sounds generated by each of the speakers in a setup. For an embodiment, a voice receiver is an omnidirectional microphone capable of recording sounds from all directions. A voice receiver measures the arrival times of sound from the speakers in a closed loop. An acoustic environment can be simulated when audio signals having different audio attributes, for example, audio signals of different frequencies, are delivered to all speakers in the setup. For example, sounds produced by the respective left speakers of display systems in a setup arrive at the voice receiver at different time intervals. The sounds are identified and recorded by the voice receiver. By using any known method such as triangulation functions, the spatial configuration of the left speakers can be determined. Other methods of determining the spatial configuration of the speakers are possible and are not precluded from embodiments of the invention.

In operation 220 (in FIG. 2), source audio signal is processed to generate synthesized audio signal based on the contents of source audio signal and the spatial configuration of the speakers. For an embodiment, one or more spatial cues present in source audio signal are modified to generate synthesized audio signal. Spatial cues of source audio signal include interaural time difference (ITD), interaural intensity difference (IID), spectra or any combination thereof. Interaural time difference (ITD) of a dual-channel stereo stream (Left+Right channels), for example, refers to the delay in time between the Left channel and the Right channel perceived by a listener. Interaural intensity difference (IID) refers to the attenuation in intensity between the Left channel and the Right channel perceived by a listener. For an embodiment, synthesized audio signal includes audio channels originally present in source audio signal as well as new audio channels not otherwise present in source audio signal. As an example, where source audio signal includes a dual-channel stereo stream (Left+Right channels), a plurality of Center channels may be generated. Center channels are generated based on the contents of Left and Right channels. One or more spatial cues of Left and Right channels are modified to create Center channels. Various techniques known in the art may be employed to generate synthesized audio signal according to embodiments of the invention. For example, known techniques employed primarily to widen the sound field perceived by a listener may be used. Such techniques allow a listener to perceive acoustics sources virtually created by existing speakers. Perceived acoustics sources may be virtually created to appear to a listener to be originating from spaces distinct from the actual physical location of the speakers. The techniques may include signal delay processing using filters and variable time delays.

For another embodiment, synthesized audio signal consists of audio channels originally present in source audio channels. For example, where source audio signal includes a three-channel stereo stream (Left+Center+Right channels), or a Surround audio stream with 5.1-channels or 7.1-channels, or any audio stream which includes Center channel, synthesized audio signal consists of audio channels originally present in source audio signal, i.e. Left, Center and Right channels. As such, no new audio channel is generated. For an embodiment, synthesized audio signal consists of synthesized audio channels for front-facing speakers. Generating synthesized audio signal would include duplicating audio channels originally present in source audio signal.

For an embodiment, processing of source audio signal to generate synthesized audio signal includes mapping synthesized audio signal to the speakers in a setup based on the spatial configuration of the speakers. The speaker a particular synthesized audio channel in synthesized audio signal is mapped to depends on the spatial configuration of the speakers in a setup. A plurality of speakers in a setup may be assumed to be center speakers based on the spatial configuration of the speakers. For example, where synthesized audio signal includes a plurality of Center channels, the plurality of Center channels are mapped to the speakers assumed to be center speakers. Embodiments of the invention may also include speakers adapted to receive the same type of synthesized audio channel in synthesized audio signal. For example, two or more speakers in a setup may be adapted to receive synthesized Left channel in synthesized audio signal.

In operation 230 (FIG. 2), synthesized audio signal is delivered to the plurality of speakers in a setup for sound output. The number of synthesized audio channels in synthesized audio signal matches the number of speakers in a setup. Each of the synthesized audio channels is delivered to the respective speaker to which the audio channels are accordingly mapped to. Synthesized audio channels may be synchronously or asynchronously delivered to the respective speakers. For an embodiment, synthesized audio channels are synchronously delivered to the respective speakers. All display systems in a setup are connected to a common set of hardware interface and are within the same clock domain. The hardware interface is driven by a common clock to align all audio channels prior to delivery and to synchronously deliver synthesized audio channels to all speakers.

Figure 3:
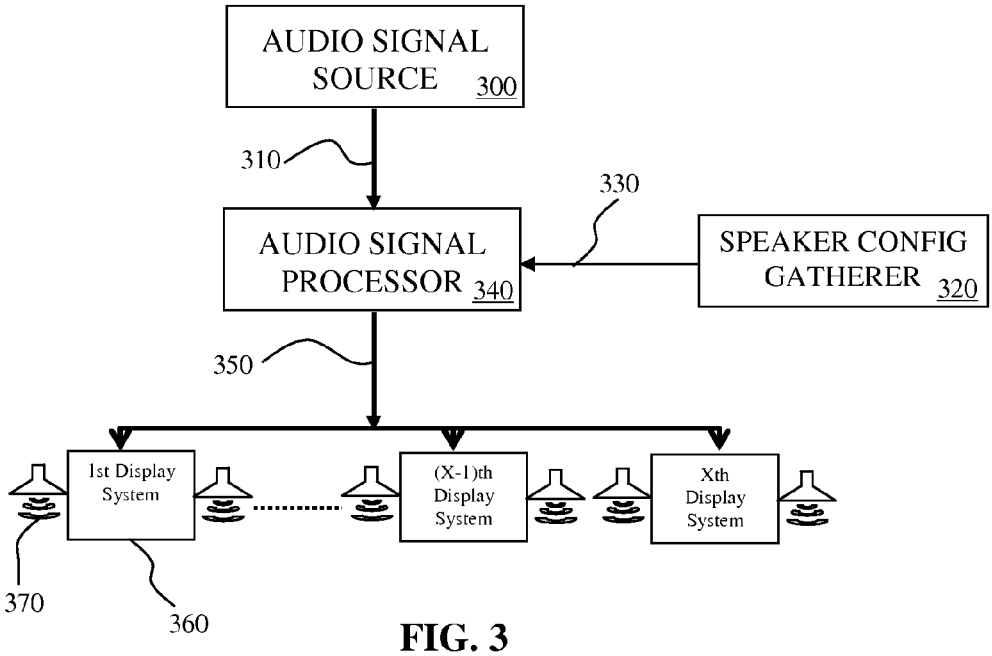
FIG. 3 is a block diagram of generating synthesized audio signal for multiple display systems according to an embodiment.

FIG. 3 is a block diagram of generating synthesized audio signal for multi-display systems according to an embodiment. Audio signal source 300 provides source audio signal 310. Audio signal source 300 includes audio-visual contents downloaded from the Internet or network servers; multimedia contents derived from playback of data storage media; application software; and input from audio hardware. Source audio signal 310 is represented in digital format. Source audio signal 310 may be digital audio signal converted from analog audio signal. Source audio signal 310 may be in readily available industry standards such as Dolby Digital, Dolby Digital Plus, AC-3, AAC, AAC+, DTS, DTS HD, DTS HD Master Audio, THX, and all other industry standard digital audio format. Source audio signal 310 includes a plurality of audio channels. Source audio signal 310 includes audio channels for front-facing speakers. For an embodiment, source audio signal 310 includes a 2-channel stereo audio stream (Left+Right channels). For another embodiment, source audio signal 310 includes a 3-channel stereo audio stream (Left+Center+Right channels).

Source audio signal 310 is provided to audio signal processor 340. Audio signal processor 340 is a digital signal processor capable of applying mathematical functions and analysis on source audio signal 310 and generating synthesized audio signal 350 based on the contents of source audio signal 310. Audio signal processor 340 is configured to process and modify source audio signal 310 and to generate an audio stream based on the spatial configuration of all speakers present in a setup. For an embodiment, audio signal processor 340 is a software application. Audio signal processor 340 may include software drivers. For another embodiment, audio signal processor 340 is an audio signal processing hardware.

Embodiments of the invention include a plurality of display systems 360. Each display system 360 has a plurality of speakers 370 capable of generating sound perceived by a listener in open air. Each display system 360 includes a front-facing speaker on the left and right sides of display system 360. Display systems 360 are arranged in a manner suitable for enjoyment of the multimedia contents rendered by display systems 360. For an embodiment, display systems 360 are arranged in a side-by-side configuration. For another embodiment, display systems 360 are arranged in a stacked configuration. Embodiments of the invention also include speaker configuration gatherer 320. Speaker configuration gatherer 320 determines the spatial configuration of all speakers 370 in a setup. Speaker configuration gatherer 320 then provides audio signal processor 340 with spatial configuration information 330 of speakers 370. Audio signal processor 340 will process source audio signal 310 and generate synthesized audio signal 350 based on spatial configuration information 330. Synthesized audio signal 350 is then delivered to speakers 370 of display systems 360 for sound output.

Figure 4:
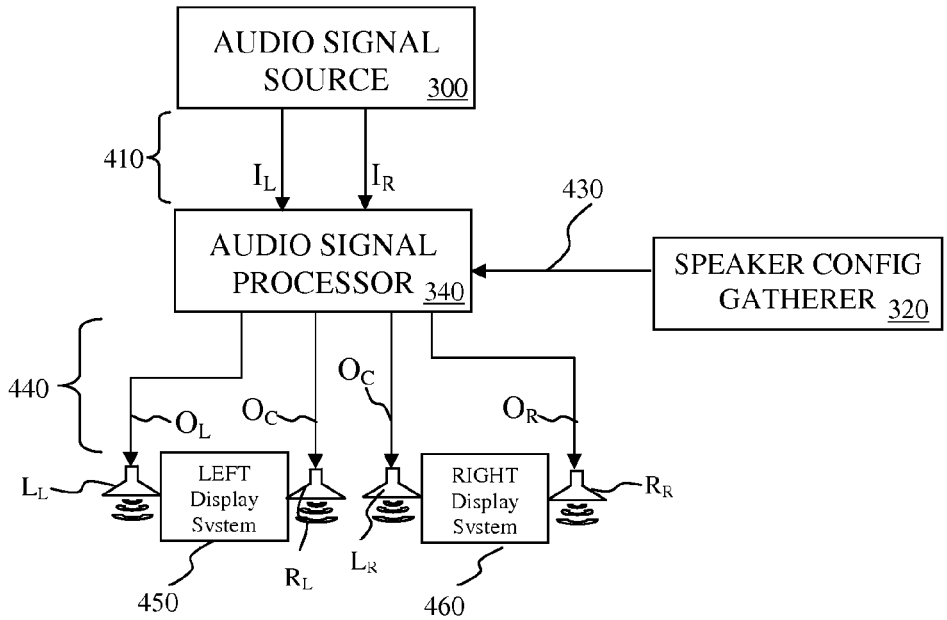
FIG. 4 is a block diagram of generating synthesized audio signal having new audio channels and being delivered to two display systems according to an embodiment.

FIG. 4 is a block diagram of generating synthesized audio signal having new audio channels and being delivered to two display systems according to an embodiment. Audio signal source 300 provides dual-channel source audio signal 410 having source Left channel $I_L$ and source Right channel $I_R$. According to an embodiment, Left display system 450 is placed on the left side of Right display system 460 in a side-by-side configuration. Left display system 450 includes left speaker $L_L$ and right speaker $R_L$ while Right display system 460 includes left speaker $L_R$ and right speaker $R_R$. Source audio signal 410 is processed by audio signal processor 340. Based on spatial configuration information 430 gathered by speaker configuration gatherer 320 and contents of source audio signal 410, audio signal processor 340 generates synthesized Center channels $O_C$ in duplicate and as part of synthesized audio signal 440. Synthesized Center channels $O_C$ have contents different from source Left channel $I_L$ and source Right channel $I_R$. Synthesized Center channels $O_C$ are each mapped and delivered to right speaker $R_L$ of Left display system 450 and left speaker $L_R$ of Right display system 460. Synthesized Left channel $O_L$ is mapped and delivered to left speaker $L_L$ of Left display system 450 while synthesized Right channel $O_R$ is mapped and delivered to right speaker $R_R$ of Right display system 460. The contents of synthesized Left channel $O_L$ and synthesized Right channel $O_R$ are identical to source Left channel $I_L$ and source Right channel $I_R$ respectively.

Figure 5:
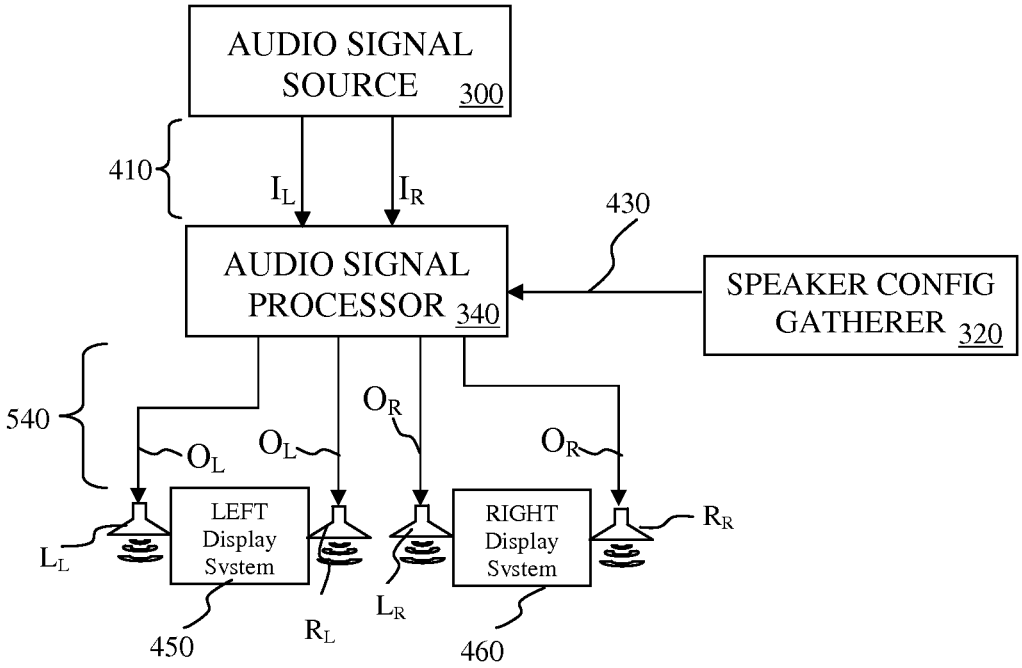
FIG. 5 is a block diagram of generating synthesized audio channels consisting of audio channels originally present in source audio signal and being delivered to two display systems according to an embodiment.

FIG. 5 is a block diagram of generating synthesized audio channels consisting of audio channels originally present in source audio signal and being delivered to two display systems according to an embodiment. Source audio signal 410 includes source Left channel $I_L$ and source Right channel $I_R$ derived from audio signal source 300. Audio signal processor 340 generates synthesized audio signal 540 having the number of channels equivalent to the number of speakers in the setup based on spatial configuration information 430 gathered by speaker configuration gatherer 320. Two synthesized Left channels $O_L$ are duplicated from source Left channel $I_L$, each being mapped and respectively delivered to left speaker $L_L$ and right speaker $R_L$ of Left display system 450. Two synthesized Right channels $O_R$ are duplicated from source Right channel $I_R$, each being mapped to and respectively delivered to left speaker $L_R$ and right speaker $R_R$ of Right display system 460.

Figure 6:
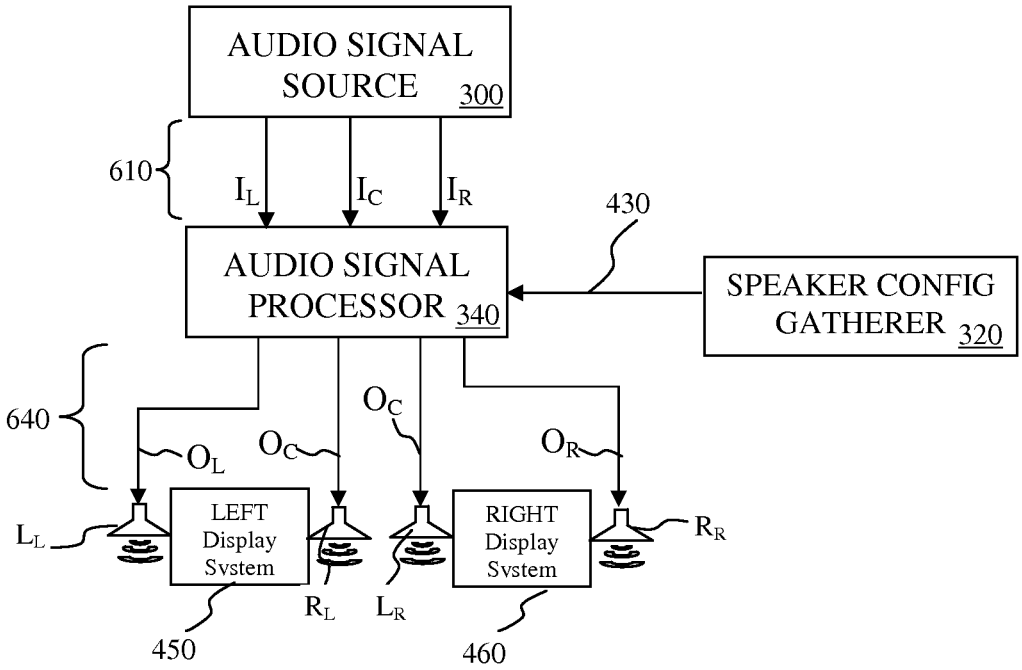
FIG. 6 is a block diagram with source audio signal including source Left channel, source Center channel and source Right channel according to an embodiment.

FIG. 6 is a block diagram with source audio signal 610 including source Left channel $I_L$, source Center channel $I_C$ and source Right channel $I_R$ according to an embodiment. Source Center channel $I_C$ may be a dialog channel. Synthesized audio signal 640 consists of audio channels originally present in source audio signal 610. Synthesized Center channels $O_C$ are duplicated from source Center channel $I_C$, mapped and delivered to right speaker $R_L$ of Left display system 450 and left speaker $L_R$ of Right display system 460. Synthesized Left channel $O_L$ shares the same content as source Left channel $I_L$, is being mapped and delivered to left speaker $L_L$ of Left display system 450. Meanwhile, synthesized Right channel $O_R$ shares the same content as source Right channel $I_R$, is being mapped and delivered to right speaker $R_R$ of Right display system 460.

Figure 7:
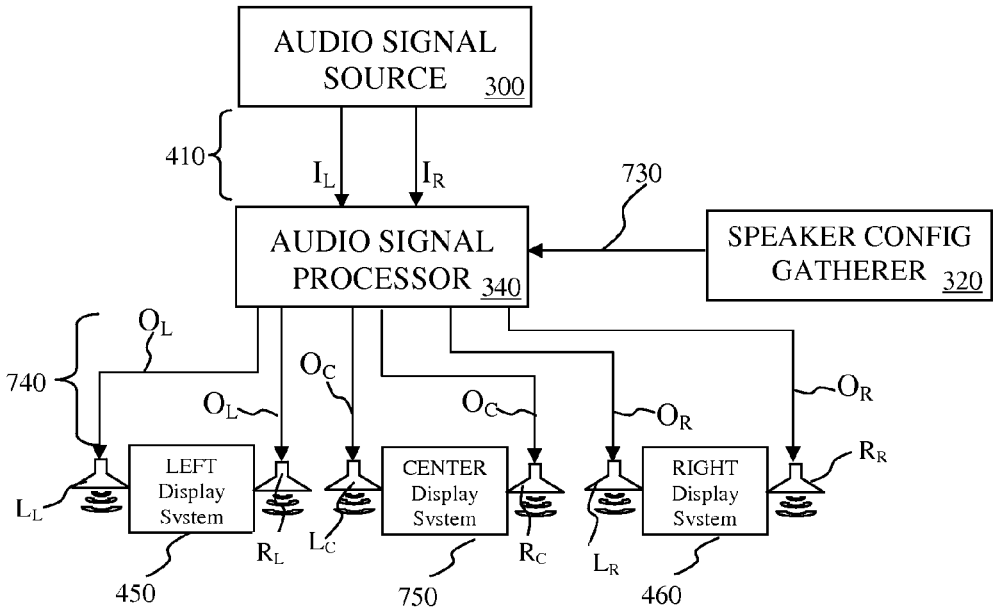
FIG. 7 is a block diagram of synthesized audio signal being delivered to three display systems according to an embodiment.
Figure 8:
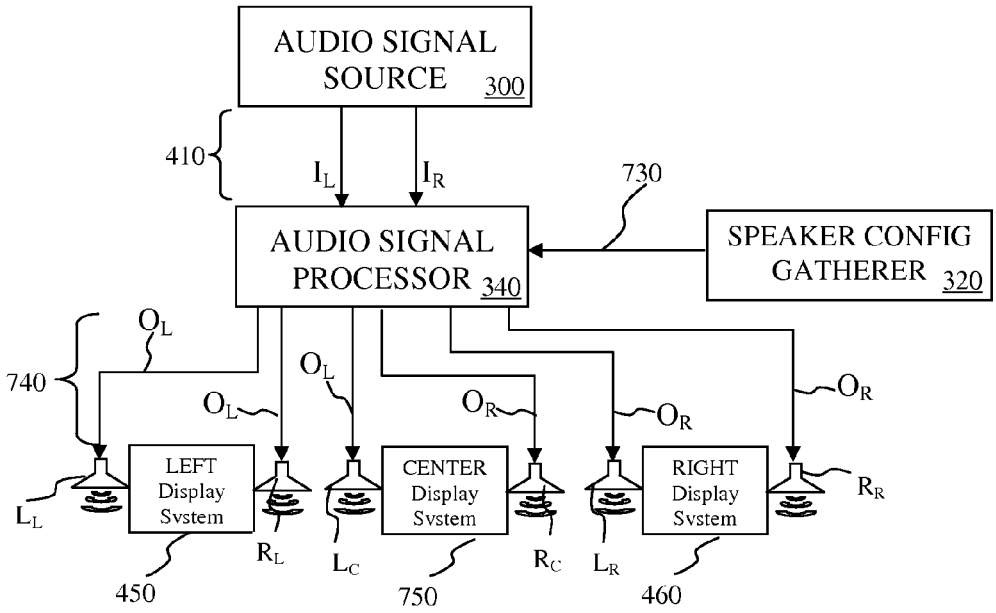
FIG. 8 is a block diagram of an embodiment with no new contents created in synthesized audio signal in a setup of three display systems.

Embodiments of the invention include a setup where three or more display systems 360 are arranged in a side-by-side configuration. FIG. 7 is a block diagram of synthesized audio signal 740 being delivered to three display systems 450, 460, 750 according to an embodiment. For example, where source audio signal 410 includes source Left channel $I_L$ and source Right channel $I_R$, synthesized audio signal 740 may include newly created synthesized Center channels $O_C$ being mapped and delivered to Left speaker $L_C$ and Right speaker $R_C$ of Center display system 750. Synthesized audio signal 740 also includes synthesized Left channels $O_L$ duplicated from source Left channel $I_L$, being mapped and delivered to Left speaker $L_L$ and Right speaker $R_L$ of Left display system 450. Meanwhile, synthesized Right channels $O_R$ are duplicated from source Right channel $I_R$, being mapped and delivered to Left speaker $L_R$ and Right speaker $R_R$ of Right display system 460. FIG. 8 is a block diagram of an embodiment with no new contents created in synthesized audio signal in a setup of three display systems. Synthesized Left channels $O_L$ are duplicated from source Left channel $I_L$, being mapped and delivered to speakers $L_L$, $R_L$ of Left display system 450 and Left speaker $L_C$ of Center display system 750. Synthesized Right channels $O_R$ are duplicated from source Right channel $I_R$, being mapped and delivered to speakers $L_R$, $R_R$ of Right display system 460 and Right speaker $R_C$ of Center display system 750.

Figure 9:
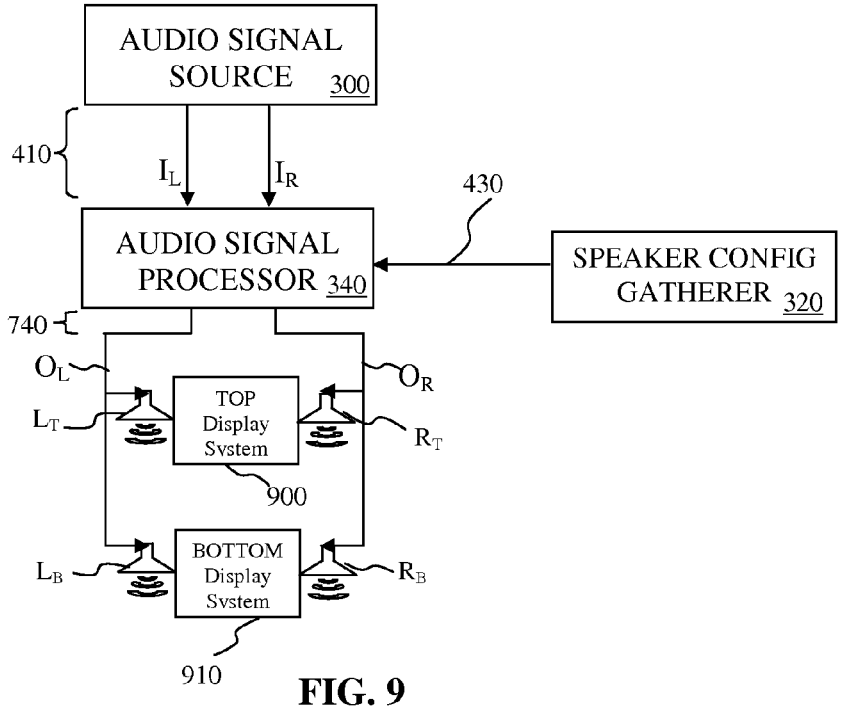
FIG. 9 is a block diagram of an embodiment having synthesized audio signal being delivered to two display systems arranged in a stacked configuration.

FIG. 9 is a block diagram of an embodiment having synthesized audio signal 740 delivered to two display systems arranged in a stacked configuration. No new contents of audio channel are created in synthesized audio signal 740. Instead, synthesized Left channels $O_L$ are generated by duplicating source Left channel $I_L$ and being delivered to Left speaker $L_T$ of Top display system 900 and Left speaker $L_B$ of Bottom display system 910. Meanwhile, synthesized Right channels $O_R$ are by duplicating source Right channel $I_R$ and being delivered to Right speaker $R_T$ of Top display system 900 and Right speaker $R_B$ of Bottom display system 910.

Figure 10:
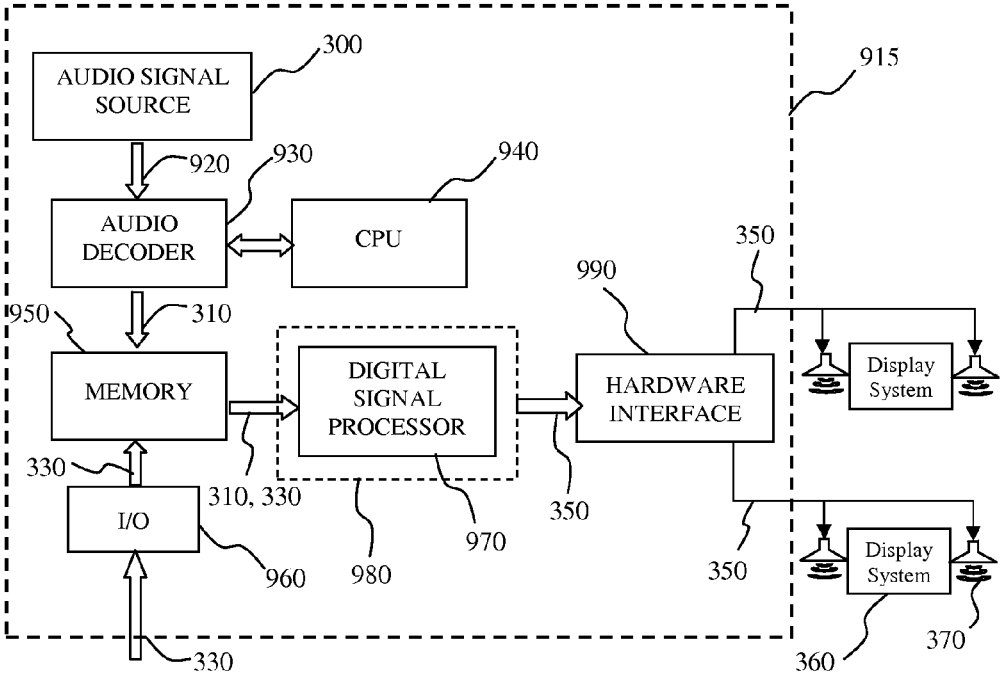
FIG. 10 is a system-level block diagram of a system to generate synthesized audio signal to multiple display systems according to an embodiment.

FIG. 10 is a system-level block diagram of a system to generate synthesized audio signal to multiple display systems according to an embodiment. System 915 includes components of a typical computer system interconnected by an internal bus structure. Audio data 920 is derived from audio signal source 300 and is channeled to audio decoder 930. Audio decoder 930 decodes audio data 920 into multi-channel source audio signal 310. Source audio signal 310 is stored temporarily in memory 330. Memory 330 may be in any form of computer memory, including but not limited to, ROM, DRAM, Flash EEPROM memory, and PROM. Embodiments of the invention include spatial configuration information 330 of all speakers 360 of display systems 370 present in a setup. Spatial configuration information 330 may be gathered by any input/output (I/O) device, fed to I/O controller hub 960, and stored in memory 330.

Still referring to FIG. 10, source audio signal 310 and spatial configuration information 330 are sent to digital signal processor 970 to generate synthesized audio signal 350. Synthesized audio signal 350 is mapped and accordingly delivered to speakers 370. Digital signal processor 970 is any standard digital signal processor capable of performing algorithmic or mathematical calculations for real time processing of source audio signal 310 and spatial configuration information 330. For an embodiment, digital signal processor 970 is an audio stack (audio driver). For another embodiment, digital signal processor 970 is a hardware-based signal processor. Digital signal processor 970 may be integrated in graphics processor unit (GPU) 970. For another embodiment, digital signal processor 970 is a controller hub such as platform controller hub (PCH) or input/output controller hub (ICH). Digital signal processor 970 is connected to hardware interface 990. Hardware interface 990 receives synthesized audio signal 350. Synthesized audio signal 350 is then delivered from system 915 to display systems 360 via hardware interface 990. Hardware interface 990 can be any digital display interface standard between audio-visual output devices and system 915. Embodiments of hardware interface 990 include, but are not limited to, DisplayPort and High-Definition Multimedia Interface (HDMI). Speakers 370 receive synthesized audio signal 350 and generate sound output with an enhanced acoustics experience.

In the foregoing specification, reference has been made to specific embodiments of the invention. It will, however be evident that various modifications and changes may be made thereto without departing from the broader spirit and scope of the invention. The specification and drawings are, accordingly, to be regarded in an illustrative rather than restrictive sense.

What is claimed is:

1. A method, comprising:

generating a source audio signal having a plurality of source audio channels;

determining a spatial configuration of a plurality of speakers, wherein each speaker is connected to a respective display system of a plurality of display systems, wherein the speakers are each fixable connected to the respective display systems, wherein determining the spatial configuration of the speakers comprises configuring a graphical user interface (GUI) to receive user input regarding the physical placement of the plurality of display systems with respect to one another;

processing the source audio signal based on the spatial configuration of the speakers and the contents of the source audio signal to generate a synthesized audio signal, the synthesized audio signal including at least one audio channel not otherwise present in the source audio signal; and delivering the synthesized audio signal to the plurality of speakers to produce an enhanced sound field.

2. The method of claim 1, wherein the spatial configuration of the speakers includes one of a two-dimensional (2D) and a three-dimensional (3D) configuration.

3. The method of claim 1, wherein processing the source audio signal includes modifying one or more spatial cues in the source audio signal.

4. The method of claim 1, wherein processing the source audio signal includes duplicating the source audio channels to generate the synthesized audio signal.

5. The method of claim 1, wherein processing the source audio signal includes mapping a plurality of synthesized audio channels in the synthesized audio signal to the respective speakers.

6. An apparatus, comprising:

a plurality of speakers, wherein each speaker is connected to a respective display system of a plurality of display systems, wherein the speakers are each fixably connected to the respective display systems;

a speaker configuration gatherer adapted to determine a spatial configuration of the speakers, wherein determining the spatial configuration of the speakers comprises a graphical user interface (GUI) configured to receive user input regarding the physical placement of the plurality of display systems with respect to one another;

a source audio signal derived from an audio signal source; and an audio signal processor adapted to:

generate a synthesized audio signal based on the contents of the source audio signal and the spatial configuration of the speakers, the synthesized audio signal including at least one audio channel not otherwise present in the source audio signal; and deliver the synthesized audio signal to the speakers to produce an enhanced sound field.

7. The apparatus of claim 6, wherein the speaker configuration gatherer is capable of determining one of two-dimensional (2D) and a three-dimensional (3D) spatial configuration of the speakers.

8. The apparatus of claim 7, wherein the audio signal processor is capable of modifying one or more spatial cues in the source audio signal.

9. The apparatus of claim 7, wherein the synthesized audio signal includes a plurality of synthesized audio channels duplicated from one or more source audio channels in the source audio signal.

10. A system, comprising:

a plurality of speakers, wherein each speaker is connected to a respective display system of a plurality of display systems, wherein the speakers are each fixably connected to the respective display systems;

a speaker configuration gatherer adapted to determine a spatial configuration of the speakers, wherein determining the spatial configuration of the speakers comprises a graphical user interface (GUI) configured to receive user input regarding the physical placement of the plurality of display systems with respect to one another;

a source audio signal derived from an audio signal source; and an audio signal processor adapted to generate a synthesized audio signal based on the contents of the source audio signal and spatial configuration of the speakers, the synthesized audio signal including at least one audio channel not otherwise present in the source audio signal; and a hardware interface adapted to receive the synthesized audio signal and to provide an audio-visual connection to the display systems to the speakers to produce an enhanced sound field.

11. The system of claim 10, wherein the speaker configuration gatherer is capable of determining one of two-dimensional (2D) and a three-dimensional (3D) spatial configuration of the speakers.

12. The system of claim 11, wherein the audio signal processor is capable of modifying one or more spatial cues in the source audio signal.

13. The system of claim 12, wherein the synthesized audio signal includes a plurality of synthesized audio channels duplicated from one or more source audio channels in the source audio signal.

* * * * *